US008540057B2

(12) United States Patent
Schuster et al.

(10) Patent No.: US 8,540,057 B2
(45) Date of Patent: Sep. 24, 2013

(54) GENERATING ELEVATOR INSTALLATION MAINTENANCE INFORMATION

(75) Inventors: Kilian Schuster, Lucerne (CH); Donato Carparelli, Lugano-Pregasona (CH)

(73) Assignee: Inventio AG, Hergiswil (CH)

( * ) Notice: Subject to any disclaimer, the term of this patent is extended or adjusted under 35 U.S.C. 154(b) by 354 days.

(21) Appl. No.: 12/921,279

(22) PCT Filed: Feb. 20, 2009

(86) PCT No.: PCT/EP2009/052024

§ 371 (c)(1),
(2), (4) Date: Dec. 1, 2010

(87) PCT Pub. No.: WO2009/109471

PCT Pub. Date: Sep. 11, 2009

(65) Prior Publication Data

US 2011/0067958 A1 Mar. 24, 2011

Related U.S. Application Data

(60) Provisional application No. 61/035,126, filed on Mar. 10, 2008.

(30) Foreign Application Priority Data

Mar. 6, 2008 (EP) ..... 08102359

(51) Int. Cl.
*B66B 1/34* (2006.01)

(52) U.S. Cl.
USPC ..... 187/391; 187/247

(58) Field of Classification Search
USPC ..... 187/247, 391–393
See application file for complete search history.

(56) References Cited

U.S. PATENT DOCUMENTS

| | | | | |
|---|---|---|---|---|
| 4,418,795 | A * | 12/1983 | Trosky et al. | 187/391 |
| 4,568,909 | A * | 2/1986 | Whynacht | 187/393 |
| 4,750,591 | A * | 6/1988 | Coste et al. | 187/391 |
| 5,787,020 | A * | 7/1998 | Molliere et al. | 702/183 |
| 5,877,462 | A * | 3/1999 | Chenais | 187/249 |
| 7,073,633 | B2 * | 7/2006 | Weinberger et al. | 187/393 |
| 7,134,530 | B2 * | 11/2006 | Motoyama et al. | 187/391 |
| 7,140,469 | B2 * | 11/2006 | Deplazes et al. | 187/316 |
| 7,140,470 | B2 * | 11/2006 | Azpitarte | 187/317 |
| 7,370,732 | B2 * | 5/2008 | Richter et al. | 187/391 |
| 7,721,852 | B2 * | 5/2010 | Ishioka et al. | 187/391 |

(Continued)

FOREIGN PATENT DOCUMENTS

| | | |
|---|---|---|
| EP | 1076030 A2 | 2/2001 |
| EP | 1277689 A1 | 1/2003 |

(Continued)

*Primary Examiner* — Anthony Salata
(74) *Attorney, Agent, or Firm* — Fraser Clemens Martin & Miller LLC; William J. Clemens

(57) ABSTRACT

An elevator system and a method for maintenance of such an elevator system include a device for receiving a plurality of sensor signals. The device is mounted on at least one elevator car or at least one counterweight of the elevator system. The device includes at least one processor and at least one computer-readable data store in at least one device housing. A first sensor for generating a sensor signal is a position sensor and/or a speed sensor and/or an acceleration sensor which is mounted in and/or on the device housing.

20 Claims, 4 Drawing Sheets

(56) References Cited

U.S. PATENT DOCUMENTS

| | | | | |
|---|---|---|---|---|
| 7,729,806 | B2 * | 6/2010 | Ohira | 700/275 |
| 7,823,706 | B2 * | 11/2010 | Tyni et al. | 187/393 |
| 8,418,815 | B2 * | 4/2013 | Encinas | 187/247 |
| 2011/0147135 | A1 * | 6/2011 | Birrer et al. | 187/393 |
| 2012/0152656 | A1 * | 6/2012 | Kocher | 187/247 |

FOREIGN PATENT DOCUMENTS

| | | | |
|---|---|---|---|
| EP | 1415947 | A1 | 5/2004 |
| GB | 2065058 | A | 6/1981 |
| WO | 2004043842 | A1 | 5/2004 |
| WO | 2007020322 | A1 | 2/2007 |

* cited by examiner

GENERATING ELEVATOR INSTALLATION MAINTENANCE INFORMATION

FIELD OF THE INVENTION

The invention relates to an elevator installation and a method for maintenance of such an elevator installation.

BACKGROUND OF THE INVENTION

EP 1415947 A1 describes a device and a method for remote maintenance of an elevator installation, wherein the device is installed at the elevator installation and first signals of the elevator installation are converted into second signals and these second signals are passed on to a telecommunications network. The device comprises a processor and a computer-readable data memory in a housing and at least one remote maintenance function is activatable by loading from the computer-readable data memory into the processor. In this manner, sensors or actuators of the elevator installation can be connected with the device and first signals originating from these sensors or actuators can be communicated to the device. The second signals converted in the device are, after passing on to the telecommunications network, evaluated in a remote maintenance center.

The present invention is based on the object of further developing this device and this method.

SUMMARY OF THE INVENTION

According to the invention the elevator installation comprises a device for detecting several sensor signals. The device is mounted on at least one car or counterweight of the elevator installation. The device comprises at least one processor and at least one computer-readable data memory in at least one device housing. A first sensor is a position sensor and/or speed sensor and/or acceleration sensor, which is arranged in and/or at the device housing.

This has the advantage that the device can automatically detect sensor signals and thus provide relevant items of maintenance information about the elevator installation independently of sensors or actuators of the elevator installation.

Advantageously the first sensor detects the movement of the car or of the counterweight. Advantageously the position sensor detects positions of the car or of the counterweight, and the speed sensor detects speeds of the car or of the counterweight. Advantageously the acceleration sensor detects accelerations and/or vibrations of the car or the counterweight.

This has the further advantage that movements of the car or the counterweight are detected by the device. In particular, the behavior over time of positions or speeds or accelerations or vibrations as well as the standstill of the car or of the counterweight are detected by the device.

Advantageously the invention also comprises the device as such, comprising at least one processor and at least one computer-readable data memory in at least one device housing, wherein the first sensor is a position sensor and/or speed sensor and/or acceleration sensor, which is arranged in and/or at the device housing. Advantageously the invention also comprises the method for normal operation of an elevator installation with such a device.

Advantageously the device comprises a second sensor arranged in and/or at the device housing. The second sensor is a camera and/or a noise level sensor and/or a light sensor and/or an infrared sensor and/or a movement sensor and/or a smoke sensor. Advantageously, the second sensor detects the car interior and/or the opening or closing of at least one door and/or at least one shaft. Advantageously the door is a car door and/or a floor door and the second sensor detects a car door threshold and a floor door threshold. Advantageously at least one interior of the shaft is detected; advantageously at least one end of the shaft is detected.

This has the particular advantage that a car occupancy or the functioning of the door or of a car lighting or the positioning of the car at a floor or an entry of the shaft by a person or changes in the shaft such as smoke or special noises, etc., is detected by the device.

The device advantageously comprises at least one communications interface. The communications interface is arranged in and/or at the device housing. Further sensor signals of at least one sensor arranged outside the device housing are detected by way of the communications interface.

This brings the advantage that the communications interface can detect further sensor signals from outside the device housing, which leads to a greater variety as well as higher accuracy in the evaluation of the sensor signals.

Advantageously the device is mounted below the car or the counterweight. Advantageously the device is mounted above the car or the counterweight. Advantageously the device is mounted laterally of the car or the counterweight. Advantageously at least one second sensor is connected with the device housing by way of a support. Advantageously at least one second sensor is connected with the device housing by way of a three-dimensionally orientable support.

This brings the further advantage that the device can be variously mounted at the car or at the counterweight. In addition, it is advantageous that the second device is selectively orientable to the elevator installation, which increases the quality of the signal information.

Advantageously the first sensor communicates first sensor signals to the processor and/or the computer-readable data memory by way of at least one signal line. Advantageously the second sensor communicates second sensor signals to the processor and/or the computer-readable data memory by way of at least one signal line. Advantageously the communications interface communicates further sensor signals to the processor and/or the computer-readable data memory by way of at least one signal line. Advantageously at least one computer program means is loaded from the computer-readable data memory into the processor by way of at least one signal line. Advantageously the communicated first sensor signals are evaluated by the computer program means in a first method step. Advantageously the communicated second sensor signals are evaluated by the computer program means in a second method step. Advantageously the communicated further sensor signals are evaluated by the computer program means in a further method step.

This brings the advantage that the detected sensor signals are already evaluated by the device and do not have to be passed on to an external evaluating unit.

Advantageously at least one item of maintenance information "differentiation of the floor position of the car" or "time plot of the floor position of the car" or "number of car journeys" or "time period of a car journey" or "time period of the car journeys" or "time plot of the car journeys" or "number of the floor stops of the car" or "time period of a floor stop of the car" or "time period of the floor stops of the car" or "time plot of the floor stops of the car" or "travel path covered by the car" or "horizontal vibrations of the car" or "vertical vibrations of the car" is evaluated from the first sensor signals.

Advantageously at least one item of maintenance information "instantaneous car occupancy" or "time plot of the car occupancy" or "number of door movements" or "instantaneous door state" or "time period of the door movement" or "time plot of the door movement" or "instantaneous state of car lighting" or "time plot of the car lighting" or "degree of horizontal and/or vertical flushness of the car door threshold with a floor door threshold" or "time plot of the degree of flushness of the car door threshold with a floor door threshold" or "instantaneous shaft state" or "time plot of the shaft state" or "noise level from a car interior" or "noise level of a door drive" or "noise level from a shaft" or "time plot of such a noise level" or "smoke from a car interior" or "smoke from an interior of a shaft" is evaluated from the second sensor signals.

Advantageously several items of maintenance information are logically interlinked by the computer program means. Advantageously an item of maintenance information "number of car journeys" is logically linked with an item of maintenance information "time plot of the car occupancy" to form an item of maintenance information "differentiation of the car occupancy" or an item of maintenance information "time period of a car journey" and an item of maintenance information "time period of a floor stop of the car" and an item of maintenance information "instantaneous car occupancy" are logically interlinked to form an item of maintenance information "trapped passenger".

This has the particular advantage that the computer program means logically links and intelligently evaluates items of maintenance information.

Advantageously with the item of maintenance information "differentiation of the car occupancy" car journeys are subdivided into a "number of empty journeys" and a "number of load-carrying journeys" or into a "number of car journeys without passengers" or "number of car journeys with one passenger" or "number of car journeys with two passengers" or "number of car journeys with three passengers" up to "number of full load journeys".

This has the advantage that the item of maintenance information "differentiation of the car occupancy" supplies a statement about the actual passenger incidence in simple mode and manner.

Advantageously at least one item of maintenance information is compared by the computer program means with at least one reference value. The reference value is loaded form the computer-readable data memory into the processor by way of the signal line. In the case of a negative comparison result at least one alarm report is generated by the computer program means and in the case of a positive computer result at least one serviceability report is generated by the computer program means. Advantageously the computer program means evaluates the detected sensor signals specific to floors.

Advantageously the device comprises at least one communications module, which is arranged in and/or at the device housing. Advantageously the communications module communicates at least one report in at least one network. Advantageously the processor is connected with the communications module by way of at least one signal line. Advantageously the alarm report or the serviceability report of the processor is communicated by the processor to the communications module by way of the signal line and communicated by the communications module in the network.

Advantageously the report in the network is communicated to at least one remote maintenance center. Advantageously at least one detected sensor signal or at least one evaluated sensor signal or at least one item of maintenance information is communicated together with the report to the remote maintenance center. Advantageously the remote maintenance center receives at least one report by at least one communications module in the network. The remote maintenance center checks the communicated report. If an alarm report is communicated, then the remote maintenance center investigates the detected sensor signal communicated with the alarm report or the evaluated sensor signal communicated with the alarm report or the item of maintenance information communicated with the alarm report and if a disturbance, which is linked with the alarm report, of an elevator installation cannot be eliminated in another mode and manner summons at least one maintenance engineer who undertakes appropriate maintenance of the elevator installation on site.

Advantageously at least one report is communicated or received from the maintenance engineer by at least one communications module in the network. At least one report or at least one detected sensor signal or at least one evaluated sensor signal or at least one item of maintenance information is communicated to the maintenance engineer by the communications module of the remote maintenance center or by the communications module of the device in the network.

This has the advantage that the maintenance engineer can perform several maintenance actions assisted by maintenance information.

Advantageously the maintenance engineer interrogates in the network an item of maintenance information "instantaneous car occupancy" at the remote maintenance center or at the device, whereupon an item of maintenance information "instantaneous car occupancy" is communicated by the communications module of the remote maintenance center or by the communications module of the device in the network. Advantageously the item of maintenance information "instantaneous car occupancy" is received by the maintenance engineer in a machine room of the elevator installation. If the received item of information "instantaneous car occupancy" indicates no passengers in a car, then the car is temporarily stopped by the maintenance engineer for maintenance.

Advantageously an item of maintenance information "time plot of the door movement" is investigated by the maintenance engineer in the remote maintenance center or on the way to the elevator installation and the correct opening or closing of at least one door is ascertained specifically to a floor.

This has the advantage that the maintenance engineer does not have to perform this maintenance action on site, which saves costs and effort.

Advantageously the device comprises an electrical power supply arranged in and/or at the device housing. Advantageously the electrical power supply supplies the processor, the computer-readable data memory, the first sensor and optionally the second sensor and/or the further sensor and/or the communications module with electrical power by way of at least one electrical power line. Advantageously the electrical power supply is designed for autonomy of the device in terms of energy for a year.

This has the particular advantage that the device is operable independently of an external electrical power supply of the building or the elevator installation.

Advantageously a computer program product comprises at least one computer program means suitable for realizing the method for maintenance of an elevator installation in such a manner that at least one method step is executed when the computer program means is loaded into the processor. Advantageously the computer-readable data memory comprises such a computer program product.

Advantageously an existing elevator installation comprising at least one car or at least one counterweight can be retrofitted with at least one device in that the device is mounted below and/or above and/or laterally of the car or the counterweight.

Advantageously an existing elevator installation comprising at least one car or at least one counterweight is modernized in that at least one device is mounted at the car or at the counterweight in that first sensor signals or further sensor signals are evaluated by the computer program means to form an item of maintenance information "number of car journeys" and second sensor signals are evaluated to form an item of maintenance information "time plot of the car occupancy". The computer program means logically links the item of maintenance information "number of car journeys" and the item of maintenance information "time plot of the car occupancy" to form an item of maintenance information "differentiation of the car occupancy". For the modernization the power of a car drive and the size of a counterweight are so designed that they correspond with the actual incidence of traffic according to the item of maintenance information "differentiation of the car occupancy".

DESCRIPTION OF THE DRAWINGS

Exemplifying embodiments of the invention are explained in more detail by way of the figures, for which purpose, in partly schematic form.

DESCRIPTION OF PREFERRED EMBODIMENTS

Figure 1:
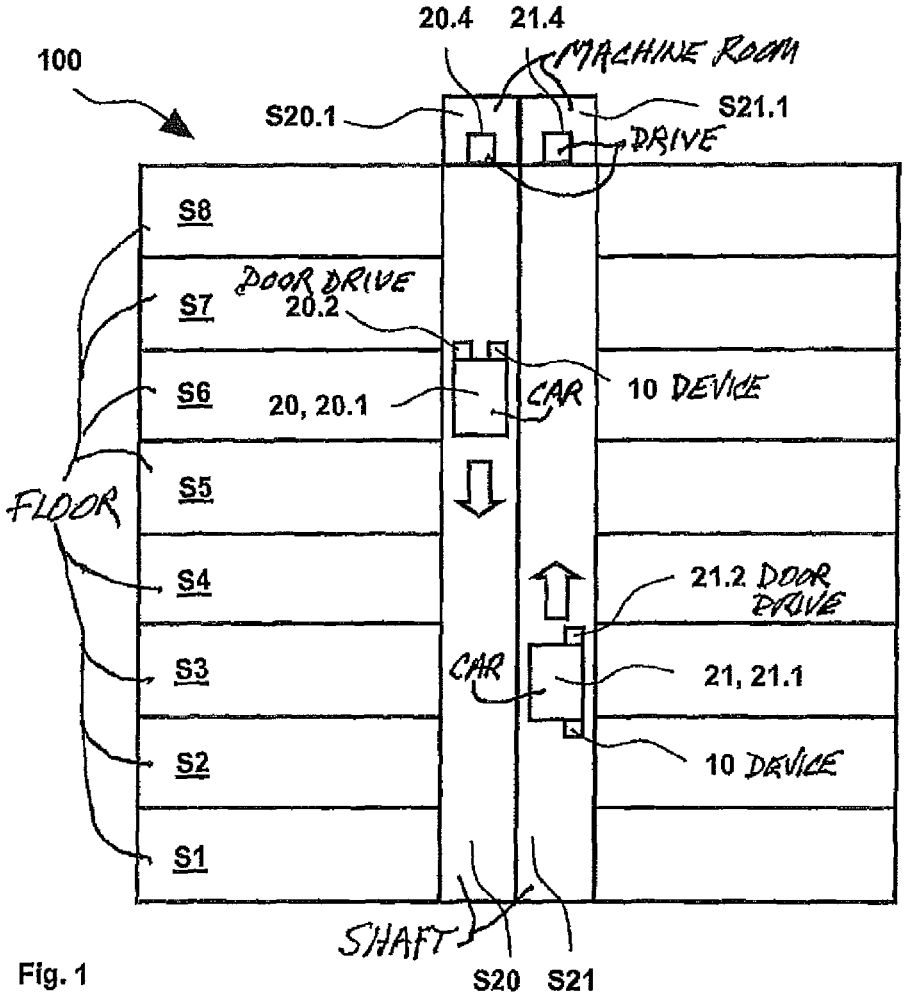
FIG. 1 shows a schematic view of a part of an elevator installation with cars and devices.
Figure 2:
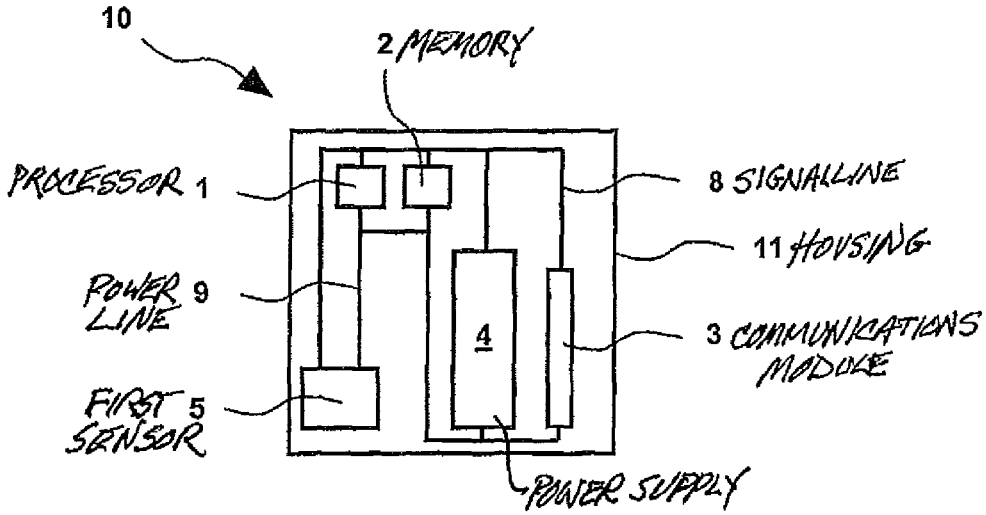
FIG. 2 shows a schematic view of a part of a first exemplifying embodiment of a device with a first sensor of the elevator installation according to FIG. 1.

FIGS. 1 to 8 show exemplifying embodiments of the invention. The elevator installation 100 is installed in a building with several floors S1-S8. At least one car 20, 21 moves passengers between the floors S1-S8 of the building in upward and downward direction. FIG. 1 shows eight floors S1-S8 and two elevator cars 20, 21 in two shafts S20, S21. The cars 20, 21 are moved by car drives 20.4, 21.4 and are connected by way of support means (not illustrated) with counterweights (similarly not illustrated). The two car drives 20.4, 21.4 are located in two machine rooms S20.1, S21.1. With knowledge of the invention the expert can, however, also realize an elevator installation with a greater or lesser number of cars for a building with a greater or lesser number of floors. The passengers can enter and leave the car interior 20.1, 21.1 of the cars 20, 21 by way of floor doors T1-T8 and car doors 20.3, 21.3. According to FIG. 7 each floor S1-S8 has at least one floor door T1-T8 and each car 20, 21 has at least one car door 20.3, 21.3. The car doors 20.3, 21.3 and floor doors T1-T8 are opened and closed by door drives 20.4, 21.4. Each car 20, 21 has a door drive 20.2, 21.2. At the floor stop, car doors 20.3, 21.3 are coupled with floor doors T1-T8 and opened or closed together by the door drive 20.2, 21.2.

The device 10 is illustrated in several exemplifying embodiments. According to FIG. 2 the device 10 comprises a first sensor 5. According to FIG. 3 the device 10 comprises a first sensor 5 and a second sensor 6. According to FIG. 4 the device 10 comprises two first sensors 5, 5'. According to FIG. 5 the device 10 comprises a first sensor 5 and two second sensors 6, 6'. According to FIG. 6 the device 10 comprises a first sensor 5, second sensor 6 and a communications interface 7. With knowledge of the present invention the expert can realize other combinations of sensors. The device 10 comprises at least one device housing 11. The sensors 5, 5', 6, 6' and the communications interface 7 are arranged in and/or at the device housing 11. According to FIGS. 1 and 6 the device 10 is mounted below and above the car 20, 21.

The first sensor 5, 5' is a position sensor and/or a speed sensor and/or an acceleration sensor. The first sensor 5, 5' is, for example, a micromechanical single or multiple sensor which is arranged on a substrate. The first sensor 5, 5' has at least one output at which first sensor signals in the form of speed and/or acceleration signals can be tapped. Embodiments of a first sensor 5, 5' are explained by way of example in the following:

- The position sensor is, for example, a piezo-electric barometer or a laser triangulation sensor or a Global Positioning System (GPS). The height measuring means or the GPS detects heights of the car 20, 21 in the shaft S20, S21 with, by way of example, a resolution of 30 centimeters. The laser triangulation sensor detects positions of the cars 20, 21 in the shaft S20, S21 over, for example, a travel range of 0 to 200 meters with, by way of example, a resolution of 5 millimeters.
- The speed sensor is, for example, a radar sensor or an ultrasound sensor. The speed sensor measures speeds of the car 20, 21 in the range of 0 to +/−10 meters/second and with, by way of example, a resolution of 10 centimeters/second. The acceleration sensor is, for example, a Hall sensor or a piezo-electric sensor or a capacitive sensor.
- The acceleration sensor measures accelerations and/or vibrations of the car 20, 21 in one, two or three axes with a resolution of, for example, 10 mg, preferably 5 mg. Vibrations are measured peak-to-peak. With knowledge of the present invention the expert can employ other measuring principles of speed and/or acceleration sensors.

The second sensor 6, 6' is a camera and/or a noise level sensor and/or a light sensor and/or an infrared sensor and/or a movement sensor and/or a smoke sensor. The second sensor 6, 6' detects the car interior 20.1, 21.2 and/or the opening or closing of at least the door 20.3, 21.3, T1-T8 and/or a car door threshold and a floor door threshold and/or the door drive 20.2, 21.2 and/or the shaft S20, S21. The second sensor 6, 6' has at least one output at which second sensor signals in the form of image signals can be tapped. Explanations of a second sensor 6, 6' are explained by way of example in the following:

The camera comprises at least one optical lens and at least one digital image sensor. The digital image sensor is, for example, a charge coupled device (CCD) sensor or a complementary metal oxide semiconductor (CMOS) sensor. The camera detects images in the spectrum of visible light. The camera can detect still images or moving images at a frequency of 0 to 30 images per second. The camera has a resolution of, for example, 1 MPixel and a sensitivity of, for example, 2 lux. The camera comprises a motor-actuated zoom lens and can thus change the focal width of the lens automatically or by remote control. Thus, objects at different distances can be detected in differently detailed image segments. The camera has a motor-actuated support so as to change the orientation of the lens automatically or by remote control. For example, the camera pans or rotates. The camera is provided with a lighting device and can thus illuminate an object which is to be detected, in weak ambient light or darkness.

The noise level sensor detects intensities and noise levels. Intensities are detected with a resolution of, for example $10^{-3}$ to $10^{+4}$ $\mu Wm^2$, and the noise level is detected in a range of, for example, 30 dB to 100 dB with, for example, a resolution of 0.1 dB.

The light sensor operates according to photoelectric effect and is, for example, a photodiode or a phototransistor. The light sensor measures the brightness in the range of, for example, 10 to 1500 lux at a resolution of ±1%.

The infrared sensor contactlessly detects heat radiation in a temperature measuring range of, for example, −30° C. to +500° C. with a resolution of ±1%. The infrared sensor delivers thermal images of the heat radiation emitted by passengers. The movement sensor is, for example, an ultrasound sensor and detects movements with a resolution of, for example 1 millimeter.

The smoke detector detects smoke particles. It is, for example, an optical or photoelectric smoke alarm operating according to the diffused light method (Tyndall effect). It comprises an optical camera with an infrared light-emitting diode which emits a test light beam and a light-sensitive sensor in the form of a photodiode which detects test light diffused at smoke particles. Optical smoke alarms detect cold smoke (smoldering fire). The sensitivity of the smoke sensor can be differently set. Replacement of the infrared light-emitting diode by a laser additionally increases the sensitivity of the smoke sensor.

The communications interface 7 is a known and proven interface for data communication with a sensor arranged outside the device housing 11. For example, the communications interface 7 is a serial interface such as a universal serial bus (USB), RS232, etc., or the communications interface 7 is a parallel interface such as a peripheral component interconnect (PCI), IEEE 1284, etc. The data communication with the sensor arranged outside the device housing 11 is effected by way of at least one signal line between the sensor and the communications interface 7.

The device 10 comprises at least one processor 1 and at least one computer-readable data memory 2, which are arranged in and/or at the device housing 11. The processor 1 and the computer-readable data memory 2 are arranged on a circuitboard and connected together by way of at least one signal line 8. The processor 1 and the computer-readable data memory 2 communicate bidirectionally in a network according to known and proven network protocols such as the Transmission Control Protocol/Internet Protocol (TCP/IP), User Datagram Protocol (UDP) or Internet Packet Exchange (IPX).

At least one computer program means is loaded from the computer-readable data memory 2 into the processor 1 and executed. The computer program means evaluates detected sensor signals. For this purpose the sensors 5, 5', 6, 6' and the communications interface 7 are connected with the processor 1 and/or the computer-readable data memory 2 by way of at least one signal line 8. The sensor signals are continuously or discontinuously detected by the sensors 5, 5', 6, 6' and the communications interface 7 and communicated to the processor 1. Sensor signals are, for example, detected at time intervals of milliseconds (msec) or seconds (sec) or minutes (min) or hours (h). The first sensor 5, 5' communicates first sensor signals, the second sensor 6, 6' communicates second sensor signals and the communications interface 7 communicates further sensor signals. The computer program means evaluates first sensor signals in a first method step, the computer program means evaluates second sensor signals in a second method step and the computer program means evaluates further sensor signals in a further method step. The computer program means determines the degree of correspondence of the detected signals with at least one reference value. The reference value is stored in the computer-readable data memory 2 and loadable into the processor 1 by way of the signal line 8. In the case of a high degree of correspondence the statement confidence and reliability of the evaluation is high and with low correspondence the statement confidence and reliability of the evaluation is low. The sensor signals evaluated by the computer program means are communicated to the computer-readable memory 2 and stored.

In the first method step first sensor signals of a position sensor and/or a speed sensor and/or an acceleration sensor are evaluated. A car journey consists of the phases: acceleration of the car 20, 21 from a start floor stop, travel of the car 20, 21 at substantially constant speed and braking of the car 20, 21 into a destination floor stop. The first sensor signal of the position sensor and/or speed sensor and/or acceleration sensor supply an unambiguous statement about a start and an end of a car journey.

First sensor signals of the position sensor supply as items of maintenance information "positions of the car 20, 21 in the shaft S20, S21". The positions detected by the position sensor are compared by the computer program means with at least one reference value in the form of a reference position. For example, reference positions give the position of the car 20, 21 at floors S1-S8. The positions detected by the position sensor are evaluated by the computer program means and indicate an instantaneous floor position of the car 20, 21.

The positions detected by the position sensor are provided with a time stamp. The computer program means ascertains from the difference of the time instants of positions of the car 20, 21 as an item of maintenance information a "time period of a car journey" or a "time period of a floor stop of the car 20, 21". The positions provided with time stamps can be summated in freely selectable time windows and supplied as an item of maintenance information a "differentiation of the floor position of the elevator car 20, 21" or a "time plot of the floor position of the car 20, 21" or a "number of car journeys" or a "time period of the car journeys" or a "number of floor stops of the car 20, 21" or a "time period of the floor stops of the car 20, 21" or a "travel path covered by the car 20, 21".

The first sensor signals of the speed sensor of the simple integration of the first sensor signals of the acceleration sensor according to time supplies or supply speeds of the car 20, 21 during the car journey. The first sensor signals of the acceleration sensor supply accelerations of the car 20, 21 during a car journey. The speeds and accelerations are detected in directionally-dependent manner and differentiated into upward journeys and downward journeys. The single integration of the first sensor signals of the speed sensor according to time or the double integration of the first sensor signals of the acceleration sensor according to time supplies, as an item of maintenance information, a "travel path of the car 20, 21 covered in the car journey". The computer program means thus ascertains from the simple integration of the first sensor signals of the speed sensor according to time or from the double integration of the first sensor signals of the acceleration sensor, as item of maintenance information, "a travel path of the car 20, 21 covered".

The computer program means thus ascertains a time instant of the start of the acceleration of the car 20, 21 from a start floor stop and a time instant at the end of braking of the car 20, 21 into a destination floor stop. The computer program means determines therefrom at least one item of maintenance information such as a "number of car journeys" or a "number floor stops of the car 20, 21". In addition, the computer program means determines, as an item of maintenance information, a "time period of a car journey" or a "time period of a floor stop of the car 20, 21" from the difference of these time instants.

Further items of maintenance information such as a "number of car journeys" or a "number of floor stops of the car 20, 21" or a "time period of a car journey" or a "time period of a floor stop of the car 20, 21" or a "travel path covered by the car 20, 21" can be summated in freely selectable time windows. This summation can be carried out specifically to a floor. The result of this summation is an item of maintenance information "time plot of the car journeys" or "time plot of the floor stops of the car 20, 21". By a time plot of a state variable there is understood the time behavior of the state variable. The "time plot of the car travels" accordingly indicates the car journeys coded in terms of time.

First sensor signals of a three-axis acceleration sensor supply, as items of maintenance information, "horizontal vibrations of the car 20, 21" or "vertical vibrations of the car 20, 21". The computer program means determines the degree of correspondence of the vibrations, which are detected by the three-axis acceleration sensor, with reference values in the form of reference vibrations. The degree of correspondence can be measured in mg and quantified. For example, horizontal vibrations are still acceptable if they lie in the range of greater than 13 mg or equal to 16 mg; horizontal vibrations are small if they lie in the range of greater than 10 mg or equal to 13 mg and horizontal vibrations are very small if they lie below 10 mg. Correspondingly, vertical vibrations are still acceptable if they lie in the range of greater than 15 mg or equal to 18 mg; vertical vibrations are small if they lie in the range of greater than 10 mg or equal to 15 mg and vertical vibrations are very small if they lie below 10 mg.

In the second method step second sensor signals of a camera and/or a noise level sensor and/or a light sensor and/or an infrared sensor and/or a movement sensor and/or a smoke sensor are evaluated.

Second sensor signals of a camera supply an image from the car interior 20.1, 21.1 and/or about the opening or closing of the door 20.3, 21.3, T1-T8 and/or from the shaft S20, S21. The image detected by the camera is evaluated by the computer program means and for this purpose compared with a reference value in the form of a reference image. The reference image indicates a reference state of the car interior 20.1, 21.1 or a reference state of a car lighting or a reference state on opening or closing of the door 20.3, 21.3, T1-T8 or a reference state of the degree of flushness of a car door threshold with a floor door threshold. For example, reference images indicate in 10% steps an empty car interior 20.1, 21.1 or a full car interior 20.1, 21.1 or a lit car interior 20.1, 21.1 or an unlit car interior 20.1, 21.1 or an open door 20.3, 21.3, T1-T8 or a closed door 20.2, 21.2, T1-T8 or a sufficient degree of flushness of the car door threshold with a floor door threshold or an insufficient degree of flushness of the car door threshold with floor door thresholds or an empty interior of the shaft S20, S21 or entry of the interior of the shaft S20, S21. With knowledge of the present invention the expert can obviously undertake other, for example finer, degrees of stepping in the comparison of the image detected by the camera with the reference image. Obviously also 5% steps or 1% steps can be undertaken instead of the afore-described 10% steps.

The computer program means determines a degree of correspondence of the image detected by the camera with the reference image. The degree of correspondence can be measured and quantified in pixel units and/or length units and/or brightness units. The computer program means determines from the comparison of the image detected by the camera with a reference image, as item of maintenance information, an "instantaneous car occupancy" as well as a time instant of the opening or closing of the door 20.3, 21.3, T1-T8 or, as item of maintenance information, an "instantaneous door state" or the "degree of horizontal and/or vertical flushness of the car door threshold with a floor door threshold" or an "instantaneous shaft state" or an "instantaneous state of the car lighting". The computer program means in that case determines, from a plurality of reference images, that image which has the greatest correspondence with the image detected by the camera.

Several images detected by the camera are compared by the computer program means as an image sequence with a reference value in the form of a reference image sequence. Thus, the opening or closing of the door 20.3, 21.3, T1-T8 is recorded as an image sequence with 25 images per second. Deviations from the reference door movement such as jamming or shuddering or reversing of the door 20.3, 21.3, T1-T8 are ascertained as a pixel difference in individual images of the image sequence with those of the reference image sequence.

The image detected by the camera can also be measured. The computer program means determines, as a further item of maintenance information, a "horizontal difference of car door threshold and floor door threshold" and/or a "vertical difference of car door threshold and floor door threshold" and compares this determined difference of car door threshold and floor door threshold with a reference value in the form of a reference difference of car door threshold and floor door threshold. A sufficient degree of flushness of the car door threshold with a floor door threshold is present when the horizontal difference of car door threshold and floor door threshold is less than or equal to 20 millimeters and/or when the vertical difference of car door threshold and floor door threshold is less than or equal to 35 millimeters; the degree of flushness is otherwise insufficient.

The image detected by the camera is provided with a time stamp. The computer program determines, as item of maintenance information, a time period of the door movement from the difference of the time instants of images in the opening and closing of the door 20.3, 21.3, T1-T8. The computer program means compares this item of maintenance information, which is determined from time stamps, "time period of the door movement" with a reference value in the form of a reference time period of the door movement. A normal door movement is present when it is between 3.5 and 3.0 seconds. A quick door movement is present when it is less than 3.0 seconds.

The result of the comparison of the image detected by the camera with the reference image can be summated in freely selectable time windows and supplies, as item of maintenance information, a "time plot of the car occupancy" or a "number of door movements" or a "time plot of the door movement" or a "time plot of the degree of flushness of the car door threshold with a floor door threshold" or a "time plot of the shaft state" or a "time plot of the car lighting". This summation can be carried out specifically to a floor. For example, the "time plot of the car occupancy" indicates the nature of the car occupancy at rush hours (morning or evening) or at weekdays (Monday to Friday) as well as weekends (Saturday and Sunday). The maintenance information "time plot of the car occupancy" thus supplies a statement about how much traffic the elevator installation 100 has to manage at which times. Since a large amount of traffic leads to wear, the maintenance information "time plot of the car occupancy" allows an installation-specific preventative maintenance. In addition, the elevator installation 100 shall be available without fault particularly where there is a large amount of traffic and the item of maintenance information "time plot of the car occupancy" thus allows an installation-specific serviceability check. The same applies to the "time plot of the door movement" or the "time plot of the degree of flushness of the car door threshold with a floor door threshold" or the "time plot of the car occupancy". Since the shaft S20, S21 in normal operation of the elevator installation 100 should not, for reasons of safety, be entered, the "time plot of the shaft state" permits a check that in fact in normal operation of the elevator installation 100 nobody enters the interior of the shaft S20, S21. This applies particularly to the ends of the shaft, i.e. the shaft head and the shaft pit. This check can be carried out permanently.

Second sensor signals of a noise level sensor supply, as item of maintenance information, "noise level from the car interior 20.1, 21.1" or "noise level from the car drive 20.2, 21.2" or "noise level from the shaft S20, S21". The noise level detected by the noise level sensor is compared by the computer program means with at least one reference value in the form of a reference noise level. The reference noise level indicates a reference state of the noise level from the car interior 20.1, 21.1 or the noise level from the door drive 20.2, 21.2 or the noise level from the shaft S20, S21.

The computer program means determines the degree of correspondence of the noise level detected by the noise level sensor with the reference noise level. The degree of correspondence can be measured and quantified in dB and/or time units. For example, a noise level from the car interior 20.1, 21.1 is satisfactory if it lies in the range of greater than 53 dB or equal to 56 dB, the noise level from the car interior 20.1, 21.1 is good when it lies in the range of greater than 50 dB or equal to 53 dB and the noise level from the car interior 20.1, 21.1 is very good when it lies below 50 dB. Correspondingly, a noise level from the door drive 20.2, 21.2 or a noise level from the shaft S20, S21 is acceptable when it is less than or equal to 60 dB.

The second sensor signals of the noise level sensor supply information about the starting and stopping of the door drive 20.1, 21.2. The computer program means thus determines the time period in which the door drive 20.2, 21.2 runs during opening or closing of the door 20.3, 21.3, T1-T8. This time period of the running of the door drive 20.2, 21.2 substantially corresponds with the item of maintenance information "time period of the door movement". The computer program means determines a degree of correspondence of the time period of the running of the door drive 20.2, 21.2 with a reference value in the form of a reference time period of the door drive. A normal door movement is present when the time period of the running of the door drive 20.2, 21.2 lies between 3.5 and 3.0 seconds. A quick door movement is present when the time period of the running of the door drive 20.2, 21.2 is less than 3.0 seconds.

The result of the evaluation of the noise level, which is detected by the noise level sensor, from the car interior 20.1, 21.1 or noise level from the door drive 20.2, 21.2 or noise level from the shaft S20, S21 can be summated in freely selectable time windows and supplies, as item of maintenance information, a "time plot of such a noise level". This summation can be carried out specifically to a floor.

Second sensor signals of a light sensor supply, as items of maintenance information, "degrees of brightness from the car interior 20.1, 21.1". The degrees of brightness detected by the light sensor are compared by the computer program means with at least one reference value in the form of a reference brightness. The computer program means determines the degree of correspondence of the degrees of brightness detected by the light sensor with the reference brightness. The degree of correspondence can be measured and quantified in lux. For example, a brightness from the car interior 20.1, 21.1 is satisfactory when it lies in the range of 50 to less than or equal to 60 lux, the brightness from the car interior 20.1, 21.1 is good when it lies in the range of 60 to less than or equal to 100 lux and the brightness from the car interior 20.1, 21.1 is very good when it lies above 100 lux. The result of this evaluation is the instantaneous state of the car lighting.

The result of the valuation of the degrees of brightness, which are detected by the light sensor, from the car interior 20.1, 21.1 can be summated in freely selectable time windows and supply the item of maintenance information "time plot of the car lighting".

Second sensor signals of an infrared sensor supply a thermal image from the car interior 20.1, 21.1. The thermal image detected by the infrared sensor is compared by the computer program means with at least one reference value in the form of a reference thermal image. The computer program means determines the degree of correspondence of the thermal image detected by the infrared sensor with the reference thermal image. The degree of correspondence can be measured and quantified in pixels. For example, reference thermal images in 10% steps indicate an empty car interior 20.1, 21.1 or a full car interior 20.1, 21.1. The computer program means thus determines, from a plurality of reference images, that which has the greatest correspondence with the thermal image detected by the infrared sensor. The computer program means determines, as item of maintenance information, an instantaneous car occupancy from the comparison of the thermal image detected by the infrared sensor with a reference numeral image.

Several thermal images detected by the infrared sensor can be compared with one another. The computer program means compares thermal images, which are successive in time, with one another and determines temperature changes in the car interior 20.1, 21.1. The computer program means determines, as item of maintenance information, an "instantaneous car occupancy" from the size and number of image regions with temperature changes.

The thermal image detected by the infrared sensor is provided with a time stamp. The result of this comparison of the thermal image detected by the infrared sensor with the reference thermal image can be summated into freely selectable time windows and supplies, as an item of maintenance information, a "time plot of the car occupancy". This summation can be carried out specifically to a floor.

Second sensor signals of a movement sensor supply movements from the car interior 20.1, 21.1 and/or about the opening or closing of the door 20.3, 21.3, T1-T8. The movements detected by the movement sensor are evaluated by the computer program means. For example, movements from the car interior 20.1, 21.1 indicate an "instantaneous car occupancy" or movements about the opening or closing of the door 20.3, 21.3, T1-T8 indicate, as item of maintenance information, an "instantaneous door state".

The movements detected by the movement sensor are provided with a time stamp. The computer program means determines, as item of maintenance information, a time period of the door movement from the difference of the time instants of movements in the opening or closing of the door 20.3, 21.3, T1-T8. The computer program means compares this item of information "time period of the door movement" ascertained from time stamps with a reference value in the form of a reference time period of the door movement. A normal door movement is present when it is between 3.5 and 3.0 seconds. A quick door movement is present when it is less than 3.0 seconds.

The movements provided with time stamps or the result of the comparison of the movements detected by the movement sensor with the reference time period can be summated in freely selectable time windows and supply, as item of maintenance information, a "time plot of the car occupancy" or a "number of door movements" or a "time period of the door movement" or a "time plot of the door movement". This summation can be carried out specifically to a floor.

Second sensor signals of a smoke sensor supply smoke data about the car interior 20.1, 21.1 and/or smoke data about the interior of the shaft S20, S21. The smoke data detected by the smoke sensor are evaluated by the computer program means. For example, smoke data from the car interior 20.1, 21.1 indicate an item of maintenance information "smoke from a car interior 20.1, 21.1" and smoke data from the interior of the shaft S20, S21 indicate an item of maintenance information "smoke from an interior of a shaft S20, S21".

Figure 3:
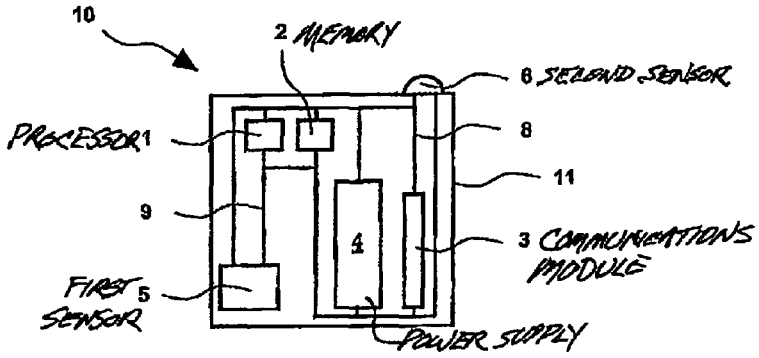
FIG. 3 shows a schematic view of a part of a second exemplifying embodiment of a device with a first sensor and second sensor of the elevator installation according to FIG. 1.

At least one first sensor 5, 5' can be combined with at least one second sensor 6, 6' and/or with at least one communications interface 7 in the device 10. Numerous combination possibilities are in that case possible. Some of these are explained by way of example in the following:

In the exemplifying embodiment according to FIG. 3 an acceleration sensor is combined with a camera in the device 10. A first sensor 5 in the form of an acceleration sensor detects accelerations of the car 20, 21, whilst a second sensor 6 in the form of a camera detects the car interior 20.1, 21.1 or the opening or closing of the door 20.3, 21.3, T1-T8. The device 10 is the device mounted below and/or above the car 20, 21. The device 10 is mounted in a light cover in the car interior 20.1, 21.1 or near the door drive 20.2, 21.2 or near the car door 20.3, 21.3.

Figure 4:
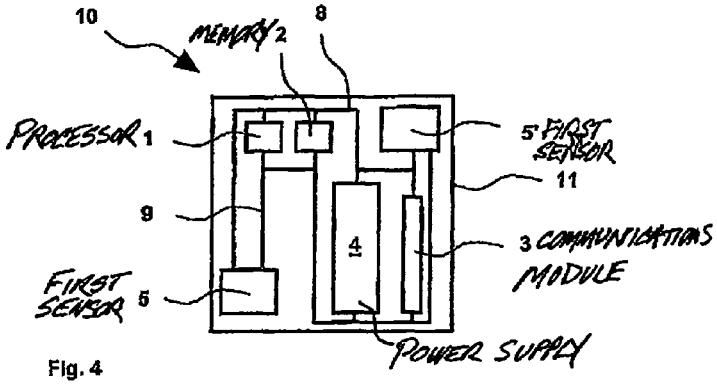
FIG. 4 shows a schematic view of a part of a third exemplifying embodiment of a device with two first sensors of the elevator installation according to FIG. 1.

In the exemplifying embodiment according to FIG. 4 two acceleration sensors are combined in the device 10. A first sensor 5 and a first sensor 5' are of identical construction and operable independently of one another. This leads to a particularly high level of serviceability of the device 10, since in the event of failure of one of the acceleration sensors the other acceleration sensor continues to supply items of maintenance information. Since this form of embodiment of the device 10 does not provide optical sensor signals from the car interior 20.1, 21.1, the device 10 can be mounted at the car 20, 21 to be completely invisible and inaccessible to passengers and is thus particularly secure against vandalism.

Figure 5:
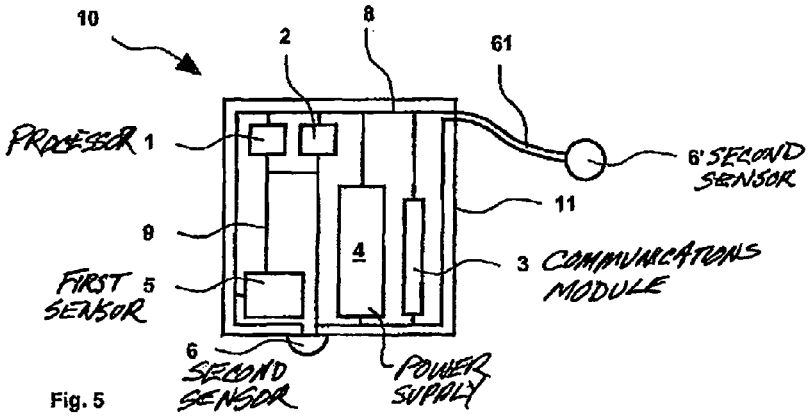
FIG. 5 shows a schematic view of a part of a fourth exemplifying embodiment of a device with a first sensor and two second sensors of the elevator installation according to FIG. 1.
Figure 7:
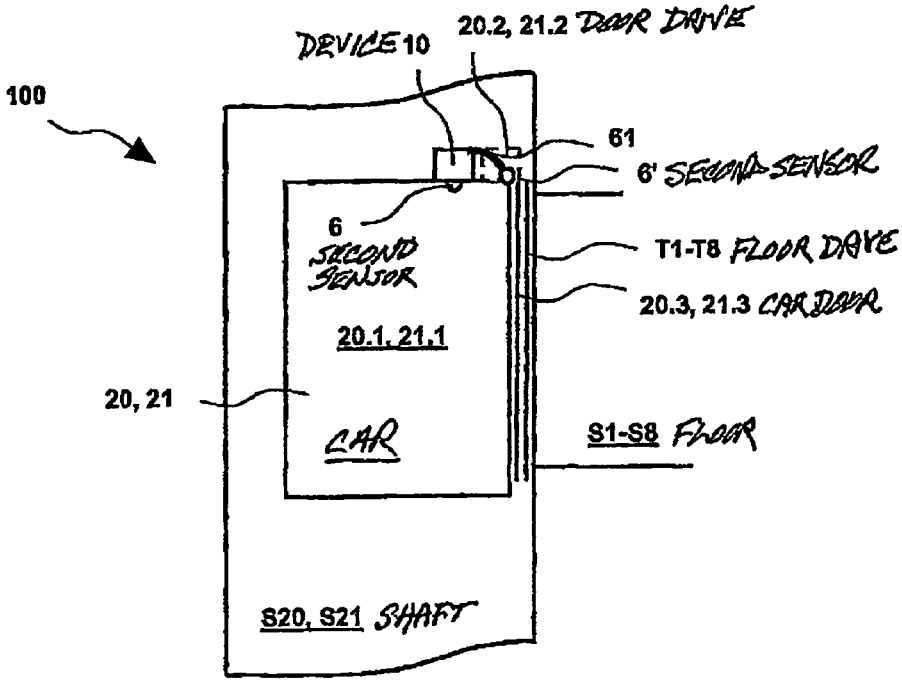
FIG. 7 shows a schematic view of a part of the elevator installation according to FIG. 1 with a device according to FIG. 3.

In the example of embodiment according to FIGS. 5 and 7 an acceleration sensor is combined with two cameras in the device 10, which leads to a multiplication in the provided items of maintenance information. A second sensor 6 in the form of a first camera can monitor the car interior 20.1, 21.1 and a second sensor 6' in the form of a second camera can monitor the opening or closing of the door 20.3, 21.3, T1-T8. For optimum alignment of the second camera this is connected with the device housing 11 by way of a support. Thus, the second camera is connected with the device housing 11 by way of a three-dimensionally orientable support 61 in the form of a flexible swan neck and aligned with respect to the door 20.3, 21.3, T1-T8.

Figure 6:
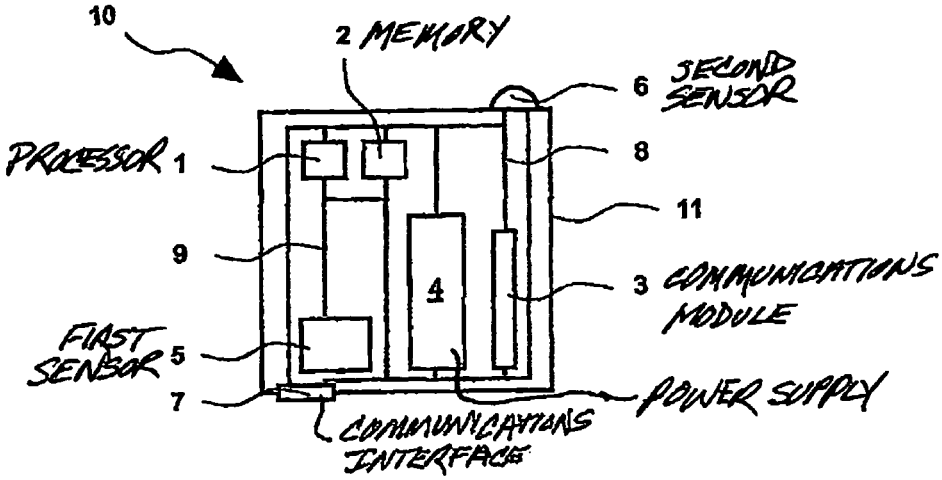
FIG. 6 shows a schematic view of a part of a fifth exemplifying embodiment of a device with a first sensor, second sensor and communications interface of the elevator installation according to FIG. 1.

In the exemplifying embodiment according to FIG. 6 an acceleration sensor is combined with a communications interface in the device 10, which leads to a desired redundancy and synergy in the thus-provided items of maintenance information. For example, the communications interface 7 is connected with at least one absolute travel pick-up of the elevator installation 100 and receives transmission from this absolute travel pick-up further sensor signals in the form of absolute travel positions of the car 20, 21 and the shaft S20, S21. Such absolute travel pick-ups, for example, mechanically engage vanes arranged in the shaft S20, S21 or read out from a magnetic strip arranged in the shaft S20, S21 or count revolutions of a running wheel arranged at the car 20, 21 and thus precisely detect the absolute position of the car 20, 21 in the shaft S20, S21. Accordingly, not only a first sensor 5 in the form of an acceleration sensor, but also the absolute travel pick-up connected by way of the communications interface 7 supply independently of one another as item of maintenance information the "number of car journeys" or the "time period of a car journey" or the "time period of the car journeys" or the "number of the floor stops of the car 20, 21" or the "time period of a floor stop of the car 20, 21" or the "time period of the floor stops of the car 20, 21" or the "travel path covered by the car 20, 21". The items of maintenance information "horizontal vibrations of the car 20, 21" or "vertical vibrations of the car 20, 21" are supplied only by the acceleration sensor, whilst the item of maintenance information "differentiation of the floor position of the car 20, 21" or "time plot of the floor position of the car 20, 21" is supplied only by the communications interface 7. In the exemplifying embodiment the device 10 according to FIG. 6 a second sensor 6 in the form of a camera is in addition provided, which camera detects the car interior 20.1, 21.1 or the opening or closing of the door 20.3, 21.3, T1-T8. The camera supplies the item of maintenance information "instantaneous car occupancy" or "time plot of the car occupancy" or "number of door movements" or "instantaneous door state" or "time period of the door movement" or "time plot of the door movement" or "instantaneous state of the car lighting" or "time plot of the car lighting" or "degree of horizontal and/or vertical flushness of the car door threshold with a floor door threshold" or "time plot of the degree of flushness of the car door threshold with a floor door threshold".

The device 10 comprises at least one communications module 3. The communications module 3 can bidirectionally communicate in a network 12. The network 12 can be realized by radio network or landline network. Known radio networks are Global System for Mobile Communications (GSM), Universal Mobile Telecommunications Systems (UMTS), Bluetooth (IEEE 802.15.1), ZigBee (IEEE 802.15.4) or WiFi (IEEE 802.11). Known landline networks are the cable-bound Ethernet, Power Line Communication (PLC), etc. PLC allows data transmission by way of the electrical power supply of the car 20, 21 or by way of other lines, which are present, of the car 20, 21. Known network protocols for communication are TCP/IP, UDP and IPX. The processor 1 is connected with the communications module 3 by way of at least one signal line 8. The processor 1 can thus communicate at least one report to the communications module 3 by way of the signal line 8 and communicate by the communications module 3 in the network 12. With knowledge of the present invention it is also possible for a sensor arranged outside the device housing 11 to also communicate, instead of the communications interface 7, by way of the communications module 3 with the device 10 and thus communicate further sensor signals in the network 12.

The report is at least one alarm report or at least one serviceability report. An alarm report or a serviceability report is generated by the processor 1 in dependence on items of maintenance information. For this purpose the computer program means compares at least one item of maintenance information with at least one reference value. In the case of a negative comparison result at least one alarm report is generated and in the case of a positive comparison result at least one serviceability report is generated.

An alarm report or serviceability report is generated when a "number of car journeys" or a "time period of a car journey" or a "time period of car journeys" or a "number of floor stops of the car 20, 21" or a "time period of a floor stop of the car 20, 21" or a "time period of floor stops of the car 20, 21" or a "travel path covered by the car 20, 21" or "horizontal vibrations of the car 20, 21" or "vertical vibrations of the car 20, 21" or an "instantaneous car occupancy" or a "time plot of the car occupancy" or a "number of the door movements" or an "instantaneous door state" or a "time period of the door movement" or a "time plot of the door movement" or an "instantaneous state of the car lighting" or a "time plot of the car lighting" or a "degree of horizontal and/or vertical flushness of the car door threshold with a floor door threshold" or a "time plot of the degree of flushness of the car door threshold with a floor door threshold" or a "noise level from a car interior 20.1, 21A" or a "noise level from a door drive "20.2, 21.2" or a "noise level from a shaft S20, S21" or a "differentiation of such a noise level" or a "time plot of such a noise level" or a "differentiation of the floor position of the car 20, 21" or a "time plot of the floor position of the car 20, 21" or a "smoke from a car interior 20.1, 21.1" or a "smoke from an interior of a shaft S20, S21" exceeds a reference value.

Several items of maintenance information can be logically interlinked by the computer program means to form items of maintenance information. Some of these are explained by way of example in the following:

Thus, the item of maintenance information "number of car journeys" can be logically linked with the item of maintenance information "time plot of the car occupancy" to form an item of maintenance information "differentiation of the car occupancy" and supplies a reference-value-dependent subdivision of the car journeys into "number of empty journeys" and "number of loaded journeys", or a subdivision of the car journeys according to number of passengers, such as: "number of car journeys without passengers", "number of car journeys with one passenger", "number of car journeys with two passengers", "number of car journeys with three passengers", etc., up to "number of full-load journeys" with maximum rated loading of the car 20, 21. The item of maintenance information "differentiation of the car occupancy" thus supplies a statement about the actual passenger incidence and enables an efficiency-optimized design of the elevator installation 100 in which the power of the car drive and the size of the counterweight are optimally matched to the actual incidence of traffic. Thus, it is possible, prior to modernization of an elevator installation, to mount the device 10 at the car 20, 21 and to detect items of maintenance information for modernization to an efficiency-optimized design of the elevator installation 100.

Thus, the three items of maintenance information "time period of a car journey", "time period of a floor stop of a car" and "instantaneous car occupancy" can be logically interlinked to form an item of maintenance information "trapped passenger". If the "instantaneous car occupancy" is equal to the reference value <zero> and if the "time period of a car journey" or the "time period of a floor stop of the car" exceeds a reference value <5 min> then a serviceability report "the car is empty for 5 min" is generated. If, however, the "instantaneous car occupancy" is not equal to the reference value <zero> and if the "time period of a car journey" or the "time period of a floor stop of the car" exceeds a reference value <5 min> then an alarm report "at least one passenger in the car for 5 min" is generated.

Figure 8:
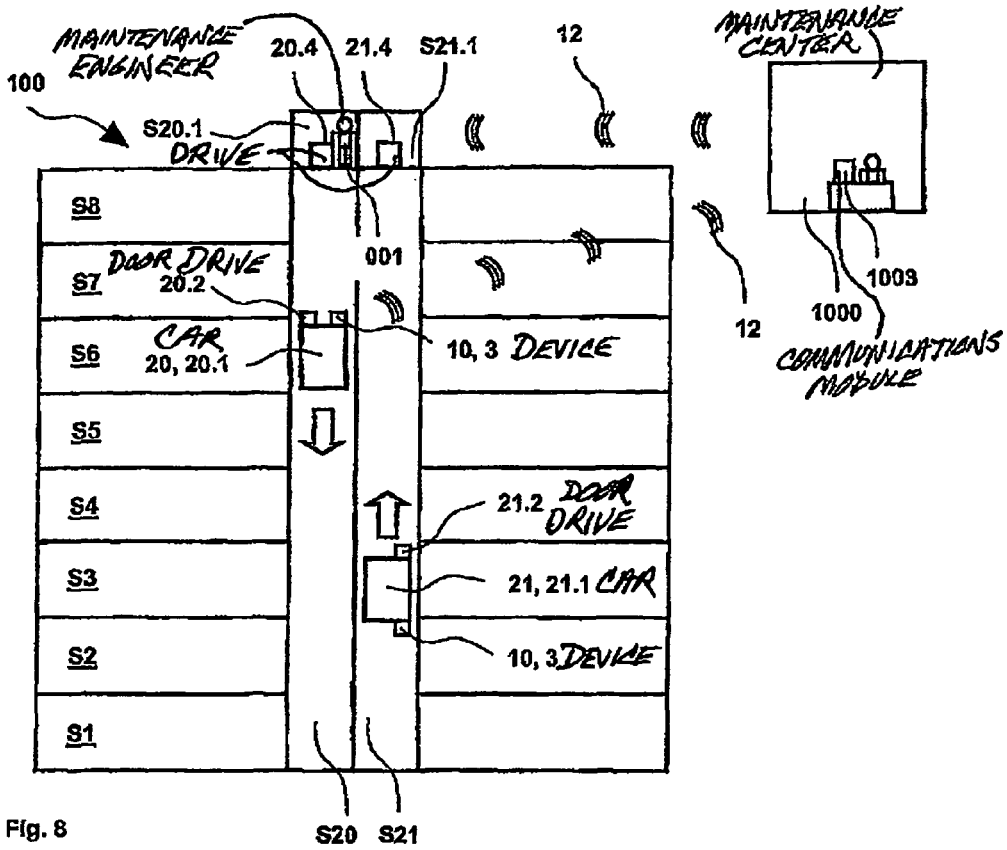
FIG. 8 shows a schematic view of a part of an elevator installation according to FIG. 1 with a remote maintenance center and a maintenance engineer.

According to FIG. 8 the alarm report or serviceability report is communicated in the network 12 to at least one remote maintenance center 1000. At least one detected sensor signal or at least one evaluated sensor signal or at least one item of maintenance information is communicated to the remote maintenance center 1000 together with the alarm report or serviceability report. The remote maintenance center 1000 has a corresponding communications module 1003 and can bidirectionally communicate in the network 12 with the communications module 3 of the device 10. The remote maintenance center 1000 checks the communicated report. If an alarm report is communicated, then the remote maintenance center 1000 checks the detected sensor signal or evaluated sensor signal or item of maintenance information communicated with the alarm report and if a disturbance, which is linked with the alarm report, of the elevator installation 100 cannot be eliminated in another mode and manner summons at least one maintenance engineer 001 who undertakes appropriate maintenance of the elevator installation 100 on site.

The maintenance engineer 001 similarly has a communications module (not shown in FIG. 8) for bidirectional communication in the network 12 with the communications module 1003 of the remote maintenance center 1000 or with the communications module 3 of the device 10. Thus, at least one report or at least detected sensor signal or at least one evaluated sensor signal or at least one item of maintenance information is communicated to the maintenance engineer 001. Several maintenance actions can thus be undertaken with maintenance information support. Some of those are explained by way of example in the following:

Thus, the remote maintenance center 1000 or the maintenance engineer 001 selectively calls up at least one item of maintenance information from the device 10. Thus, the maintenance engineer 001 can, from the machine room S20.1, S21.1, interrogate by a communications module, in the form of a mobile telephone, in the network 12, in the form of a radio network, the item of maintenance information "instantaneous car occupancy" at the remote maintenance center 1000 or the device 10, whereupon the maintenance engineer 001 has transmitted as answer in the network 12 as item of maintenance information "instantaneous car occupancy" an image of the car interior 20.1, 21.1. The image is, for example, a Multimedia Messaging Service (MMS) on the mobile telephone of the maintenance engineer 001. Thus, the maintenance engineer 001 can, in the machine room S20.1, S21.1, ensure in simple and quick manner whether anybody is in the car interior 20.1, 21.1 without having to leave the machine room S20.1, S21.1 for this purpose or having to request a further maintenance engineer with a visual check. This item of maintenance information is of significance particularly in the frequently occurring case of the maintenance engineer having to temporarily stop a car 20, 21 for maintenance actions.

Thus, a maintenance engineer 001 can investigate, either in the remote maintenance center 1000 or also on the way to the elevator installation 100, the item of maintenance information, which was transmitted by the communications module 3 of the device 10, "time plot of the door movement" and thus establish in floor-specific manner the quality of the door opening without, as previously usual, even having to go on site to any floor S1-S8 to check the correct opening and closing of the car doors 20.3, 21.3 coupled with the floor doors T1-T8. This saves time and effort.

Thus, the remote maintenance center 1000 or a maintenance engineer 001 can derive from the item of maintenance information "time plot of the car journeys" or "time plot of the car occupancy" a favorable point in time for a maintenance visit, where, in particular, little traffic is anticipated and a possible switching-off of a car 20, 21 of the elevator installation 100 causes little disturbance.

Thus, the network 12 can consist of a combination of landline and radio network. For example, the device 10 communicates with the remote maintenance center 1000 by way of a landline network such as PLC whilst the remote maintenance center 1000 and the maintenance engineer 001 communicate by way of a radio network such as GSM.

Thus, the maintenance engineer 001 can not only exchange the electrical power supply 4 of the device 10, but also exchange or remove other components of the device 10 such as the computer-readable data memory 2 or the processor 1. This has the advantage that detected sensor signals or evaluated sensor signals or items of maintenance information stored in the computer-readable data memory 2 do not have to be transmitted by way of the radio network 12 to a remote maintenance center 1000, but the computer-readable data memory 2, which has been removed from the device 10, with these data is transported to the remote maintenance center 1000 and these data are read out there.

Thus, the maintenance engineer 001 can also communicate by way of a call input terminal of the elevator installation 100 with the device 10 or the remote maintenance center 1000. Such a call input terminal has input means such as buttons, knobs, etc., and output means such as lights, screen, etc., and is located in the car 20, 21 or in front of the floor doors T1-T8. The call input terminal is connected with the device 10 or the remote maintenance center 1000 by way of at least one network adapter. The maintenance engineer 001 can reconfigure such a call input terminal by a secret code in such a manner that the reconfigured call input terminal establishes a communication in the network 12 with the device 10 or the remote maintenance center 1000. Detected sensor signals or evaluated sensor signals or items of maintenance information can then be issued for the maintenance engineer 001 on the output means of the call input terminal.

The device 10 or the remote maintenance center 1000 can also communicate to a further communications module sensor signals detected by the device 10 or evaluated sensor signals or items of maintenance information in the network 12. Such a further communications module is, for example, a mobile telephone of a passenger or a dwelling control center in a dwelling of a passenger or a building control center in the building of the elevator installation 100. The dwelling control center or building control center is a communications module with an input means such as buttons, knobs, etc., and output means such as lights, screens, etc., and a network adapter. Thus, a passenger can, before he or she leaves a dwelling in the building, call up by the building control center in the network 12 the item of information "instantaneous car occupancy" at the remote control center 1000 or the device 10. As answer the passenger obtains transmission in the network 12 of the item of maintenance information "instantaneous car occupancy" as an image of the car interior 20.1, 21.1 on the screen. The passenger can thus ensure prior to a journey by a car 20, 21 whether and which passengers are present in the car 20, 21. In the same mode and manner a building control center can monitor the safe transport of the passenger by the item of maintenance information "instantaneous car occupancy".

The device 10 comprises at least one electrical power supply 4. The electrical power supply 4 is arranged in and/or at the device housing. The electrical power supply 4 is, for example, a battery or an accumulator or a fuel cell or a solar cell or a wind turbine. The electrical power supply 4 supplies, by way of at least one electrical power line 9, the processor 1, the computer-readable data memory 2, the first sensor 5, 5' and optionally the second sensor 6, 6' and/or the communications interface 7 and/or the communications module 3 with electrical power. The electrical power supply 4 is designed for autonomy of the device 10 in terms of energy for a year. The electrical power supply 4 is, for example, renewed by exchange of the battery or the accumulator or the fuel cell. This exchange can be carried out by the maintenance engineer 001. The electrical power supply 4 can, however, also be recharged by connection of a further electrical power supply by way of at least one electrical power line or inductively. The further electrical power supply can be an electrical power supply of the car 20, 21 or of the elevator installation 100.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having a device for detecting a plurality of sensor signals, wherein the device is mounted on a car or a counterweight of the elevator installation, the device comprising:

a processor;

a computer-readable data memory connected to said processor and at least one computer program loaded from said memory to said processor;

a device housing at which said processor and said computer-readable data memory are located, said device housing being mounted on the car or the counterweight of the elevator installation; and a first sensor being at least one of a position sensor, a speed sensor and an acceleration sensor, said first sensor being arranged at said device housing for generating a first sensor signal to said processor, said processor executing said computer program to evaluate said first sensor signal and generate at least one item of maintenance information.

2. The elevator installation according to claim 1 wherein said first sensor detects movement of the car or the counterweight and generates said first sensor signal representing at least one of positions in a shaft of the elevator installation, speed, acceleration and vibrations of the car or the counterweight.

3. The elevator installation according to claim 1 including a second sensor being at least one of a camera, a noise level sensor, a light sensor, an infrared sensor, a movement sensor and a smoke sensor, said second sensor being arranged at said device housing for generating a second sensor signal to said processor, said processor executing said computer program to evaluate said second sensor signal and generate at least one item of maintenance information.

4. The elevator installation according to claim 3 wherein said second sensor detects at least one of a car interior, an opening or closing of a car door, an opening or closing of a floor door, a car door threshold, a floor threshold, an interior of an elevator shaft and an end of an elevator shaft for generating said second sensor signal.

5. The elevator installation according to claim 3 wherein said second sensor is connected with said device housing by a fixed support or a three-dimensionally orientable support.

6. The elevator installation according to claim 1 including a communications interface arranged at said device housing for detecting further sensor signals generated by at least one sensor arranged outside said device housing, said processor executing said computer program to evaluate said further sensor signals to generate at least one item of maintenance information.

7. The elevator installation according to claim 1 including a communications module arranged at said device housing for at least one of communicating and receiving a report in a network.

8. The elevator installation according to claim 1 including an electrical power supply arranged at said device housing, said electrical power supply supplying said processor, said computer-readable data memory, and at least one of said first sensor, a second sensor, a communications interface, and a communications module with electrical power by at least one electrical power line.

9. The elevator installation according to claim 1 wherein the device is mounted at least one of under, above and laterally of the car or the counterweight.

10. A method of maintaining an elevator installation having a device mounted at a car or a counterweight of the elevator installation for detecting a plurality of sensor signals, comprising the steps of:

providing the device with a processor and a computer-readable data memory located at a device housing mounted on the car or the counterweight;

providing a first sensor arranged at the device housing and being at least one of a position sensor, a speed sensor and an acceleration sensor;

communicating first sensor signals generated from the first sensor to at least one of the processor and the computer-readable data memory; and executing in the processor a computer program loaded from the memory to evaluate the first sensor signals and generate at least one item of maintenance information.

11. The method according to claim 10 including providing a second sensor arranged at the device housing and being at least one of a camera, a noise level sensor, a light sensor, an infrared sensor and a movement sensor; communicating second sensor signals generated by the second sensor to at least one of the processor and the computer-readable data memory; and executing in the processor the computer program to evaluate the second sensor signals and generate at least one item of maintenance information.

12. The method according to claim 10 including providing a communications interface arranged at the device housing, providing a sensor arranged outside the device housing, detecting further sensor signals generated by the sensor arranged outside the device housing with the communications interface, communicating the further sensor signals from the communications interface to at least one of the processor and the computer-readable data memory, and executing in the processor the computer program to evaluate the further sensor signals and generate at least one item of maintenance information.

13. The method according to claim 10 including loading the computer program from the computer-readable data memory into the processor, and performing at least one of the steps of:

evaluating the first sensor signals by the computer program in a first method step;

evaluating second sensor signals generated from a second sensor at the device housing by the computer program in a second method step;

evaluating further sensor signals generated from a further sensor outside the device housing by the computer program in a further method step; and generating at least one item of maintenance information from the processor in response to the evaluations.

14. The method according to claim 13 including generating from the first sensor signals an item of maintenance information including at least one of "differentiation of the floor position of the car", "time plot of the floor position of the car", "number of car journeys", "time plot of a car journey", "time period of the car journeys", "time plot of the car journeys", "number of the floor stops", "time period of a floor stop of the car", "time period of the floor stops of the car", "time plot of the floor stops of the car", "travel path covered by the car", "horizontal vibrations of the car", and "vertical vibrations of the car".

15. The method according to claim 13 including generating from the second sensor signals an item of maintenance information including at least one of "instantaneous car occupancy", "time plot of the car occupancy", "number of door movements", "instantaneous door state", "time plot of the door movement", "instantaneous state of car lighting", "time plot of the car lighting", "degree of horizontal and/or vertical flushness of the car door threshold with a floor door threshold", "time plot of the degree of horizontal and/or vertical flushness of the car door threshold with a floor door threshold", "instantaneous shaft state", "time plot of the shaft state", "noise level from a car interior", "noise level of a door drive", "noise level from a shaft", "time plot of such a noise level", "smoke from a car interior", and "smoke from an interior of a shaft".

16. The method according to claim 13 including evaluating the first, second and further sensor signals, generating from the evaluated first, second and further sensor signals a plurality of items of maintenance information and logically interlinking the items by a computer program.

17. The method according to claim 16 including at least one of: an item of maintenance information "number of car journeys" is logically linked with an item of maintenance information "time plot of the car occupancy" to form an item of maintenance information "differentiation of the car occupancy"; and an item of maintenance information "time period of a car journey", an item of maintenance information "time period of a floor stop of the car" and an item of maintenance information "instantaneous car occupancy" are logically interlinked to form an item of maintenance information "trapped passenger".

18. The method according to claim 13 including generating from one of the evaluated first, second and further sensor signals an item of maintenance information, comparing the item of maintenance information with a reference value by the computer program, and loading the reference value into the processor from the computer-readable data memory.

19. The method according to claim 18 wherein in case of a negative comparison result generating an alarm report by the computer program and in case of a positive comparison result generating a serviceability report by the computer program.

20. A method of maintaining an elevator installation having a device mounted at a car or a counterweight of the elevator installation for detecting a plurality of sensor signals, comprising the steps of:

providing the device with a processor and a computer-readable data memory located at a device housing mounted on the car or the counterweight;

providing a sensor arranged at the device housing;

communicating sensor signals generated from the sensor by a signal line to at least one of the processor and the computer-readable data memory;

generating from one of the sensor signals an item of maintenance information by executing in the processor a computer program loaded from the memory;

comparing the item of maintenance information with a reference value in the processor to generate a report;

in case of a negative comparison result generating the report as an alarm report;

communicating the report to a remote maintenance center with at least one of a detected sensor signal, an evaluated sensor signal, and an item of maintenance information; and if the alarm report is communicated to the remote maintenance center, the detected sensor signal or the evaluated sensor signal or the item of maintenance information communicated with the alarm report is investigated by the remote maintenance center, and if at least one disturbance, which is linked with the alarm report, of the elevator installation cannot be eliminated in another mode and manner, a maintenance engineer who undertakes appropriate maintenance of the elevator installation on site is summoned by the remote maintenance center.

* * * * *